US006345629B1

(12) United States Patent
Vives

(10) Patent No.: US 6,345,629 B1
(45) Date of Patent: Feb. 12, 2002

(54) POCKET TOOTHBRUSH

(76) Inventor: Joseph Antoine Vives, 27, rue de Boishue F-95400, Arnouville-les-Gonesse (FR)

( * ) Notice: Subject to any disclaimer, the term of this patent is extended or adjusted under 35 U.S.C. 154(b) by 0 days.

(21) Appl. No.: 09/529,635

(22) PCT Filed: Oct. 7, 1998

(86) PCT No.: PCT/FR98/02138

§ 371 Date: Apr. 17, 2000

§ 102(e) Date: Apr. 17, 2000

(87) PCT Pub. No.: WO99/20151

PCT Pub. Date: Apr. 29, 1999

(30) Foreign Application Priority Data

Oct. 16, 1997 (FR) ..... 97 12977

(51) Int. Cl.[7] ..... A45D 44/18; A46B 9/04

(52) U.S. Cl. ..... 132/308; 132/309; 132/310; 15/167.1

(58) Field of Search ..... 132/309, 308, 132/310, 311; 15/167.1; 401/175, 269, 194

(56) References Cited

U.S. PATENT DOCUMENTS 3,728,035 A * 4/1973 Reitknecht ..... 401/171
4,071,300 A * 1/1978 Nichols et al. ..... 401/175
4,145,147 A * 3/1979 Schuck ..... 401/175
4,291,995 A * 9/1981 Dikoff ..... 401/175
4,957,125 A 9/1990 Yaneza
5,066,155 A * 11/1991 English ..... 401/175

FOREIGN PATENT DOCUMENTS

| | | |
|---|---|---|
| FR | 2 537 856 | 6/1984 |
| FR | 2 597 734 | 10/1987 |
| FR | 2 600 513 | 12/1987 |
| GB | 2 290 702 | 1/1996 |
| GB | 2 302 499 | 1/1997 |

* cited by examiner

*Primary Examiner*—John J. Wilson
*Assistant Examiner*—Robyn Kieu Doan
(74) *Attorney, Agent, or Firm*—Young & Thompson

(57) ABSTRACT

A toothbrush includes a hollow handle designed to be filled with a pasty product for cleaning teeth and a brush provided with bristles, the handle and the brush being provided with mutually abutting fixing elements. The handle forms a reservoir for the pasty product and comprises a hole for allowing the product to flow through and elements for controlling a piston housed in the reservoir and designed to force the pasty product through the hole. The piston comprises a central threaded hole cooperating with a threaded rod passing through a closure of the reservoir second end and integral with the piston control knob, the threaded rod and the control knob being mobile in rotation and in translation. The toothbrush comprises elements for limiting the piston axial travel, arranged between the piston and the closure, and axially integral with the rod.

11 Claims, 2 Drawing Sheets

POCKET TOOTHBRUSH

CROSS REFERENCE TO RELATED APPLICATION

This is the 35 USC 371 national stage of International application PCT/FR98/02138 filed on Oct. 7, 1998, which designated the United States of America.

FIELD OF THE INVENTION

The present invention relates to a toothbrush.

It is known that for dental hygiene it would be desirable to brush the teeth after each meal. Modern life hardly lends itself to such obligations, as most active people take their lunchtime meal away from their home, in a canteen, restaurant, etc.

BACKGROUND OF THE INVENTION

The document FR-2 537 856 (VIVES) discloses a toothbrush that can be carried and used easily anywhere.

The toothbrush has a body formed of a hollow handle adapted to be filled with toothpaste and a brush member with lateral bristles in the vicinity of the end of the handle, which is formed of two parts having at their corresponding ends means for fixing them together end-to-end, the first part having bristles and the second part forming a reservoir for the toothpaste and having at one end an outflow hole for the toothpaste and at the other end means for actuating a piston housed in the reservoir and adapted to expel toothpaste through the outflow hole. The piston has a screwthreaded central hole into which is screwed a screwthreaded rod one end of which passes through a stopper at the end of the second part opposite that with the outflow hole and which is fastened to the means for actuating the piston, which are formed by a plunger.

The above toothbrush is of simple construction and, when the two parts are separated, allows toothpaste to be applied to the bristles and the teeth to be brushed, the toothbrush and the toothpaste being carried in a jacket pocket or handbag.

However, the outflow of toothpaste is effected by unscrewing the plunger to move it away from the reservoir and then pushing the plunger axially towards the reservoir, which directly causes axial displacement of the piston and outflow of toothpaste. It can therefore be seen that the quantity of toothpaste that flows out will depend on the number of turns through which the plunger has been rotated, in other words on the distance established between the plunger and the reservoir.

However, users will generally attempt to operate the plunger with only one hand, the other hand holding the brush part. As a result the amount of toothpaste that the user applies to the bristles will vary considerably from one use to another, and can be excessive. This excess toothpaste will result in accelerated emptying of the reservoir, whose volume is necessarily limited because of its small dimensions. The user will therefore have to replace the reservoir of toothpaste too soon, which makes the toothbrush less agreeable to use.

SUMMARY OF THE INVENTION

The object of the present invention is to remedy the drawbacks of the toothbrush described hereinabove by providing a toothbrush with a toothpaste metering device.

The toothbrush according to the invention is of the type having a hollow handle adapted to be filled with toothpaste and a brush part with bristles, the handle and the brush part having means for fixing them together end-to-end. The handle forms a reservoir for the toothpaste and has at a first end an outflow hole for the toothpaste and at a second end means for actuating a piston housed in the reservoir and adapted to expel the toothpaste through the outflow hole. The piston has a screwthreaded central hole co-operating with a screwthreaded rod one end of which passes through a stopper at the second end of the reservoir and is fastened to a knob for actuating the piston, the screwthreaded rod and the actuator knob being mobile in rotation and in translation.

The toothbrush according to the invention includes means for limiting the axial travel of the piston disposed between the piston and the stopper and fastened axially to the rod. The volume of toothpaste expelled by the piston is proportional to the axial travel of said piston and limiting its axial travel therefore limits the quantity of toothpaste applied to the brush part.

In one embodiment of the invention the means for limiting the travel of the piston are prevented from rotating relative to the rod. The screwthreaded rod and the means for limiting the travel of the piston can be in one piece.

The means for limiting the travel of the piston advantageously include a disc whose diameter is greater than that of the screwthreaded rod and which has an abutment surface adapted to come into contact with a corresponding surface of the stopper. Thus, when the user turns the actuator knob, the screwthreaded rod and the disc move with a helicoidal motion and the actuator knob moves away from the reservoir. When the screwthreaded rod and the disc have travelled a distance corresponding to the predetermined dose, the disc comes into contact with the stopper, which immobilizes it. The abutment surfaces of the disc and the stopper can be provided with lugs designed to prevent the disc rotating relative to the stopper after they come into contact.

In one embodiment of the invention the disc is at a maximum distance from the stopper of 1.7 mm, for example, and this distance is proportional to the required volume of toothpaste.

The actuator knob is mobile in translation and in rotation and is fastened to the screwthreaded rod.

The invention provides a toothbrush which has a reserve of toothpaste enabling a given number of uses. The user knows in advance how many times they can brush their teeth with the toothbrush. A system can be provided to indicate the number of brushings remaining, for example by providing the body of the reservoir with a graduated transparent wall portion through which the user can see the piston.

BRIEF DESCRIPTION OF THE DRAWINGS

The present invention will become clearer and other advantages will become apparent in the course of the following detailed description of one embodiment of the invention, which is given by way of non-limiting example only and illustrated by the accompanying drawings, in which.

DETAILED DESCRIPTION OF THE INVENTION

Referring to the figures, the toothbrush has an elongate cylinder body 1 with a cylindrical hollow interior 2 which forms a reservoir and is open at an open first end 1*a* of the cylinder body 1. A second end 1*b* of the cylinder body 1 has a male part 1*c* projecting outwards and carrying an attachment lug 3. The hollow interior 2 provides a toothpaste reservoir and communicates with the outside through an axial orifice 2*a* in the male part 1*c*.

Figure 1:
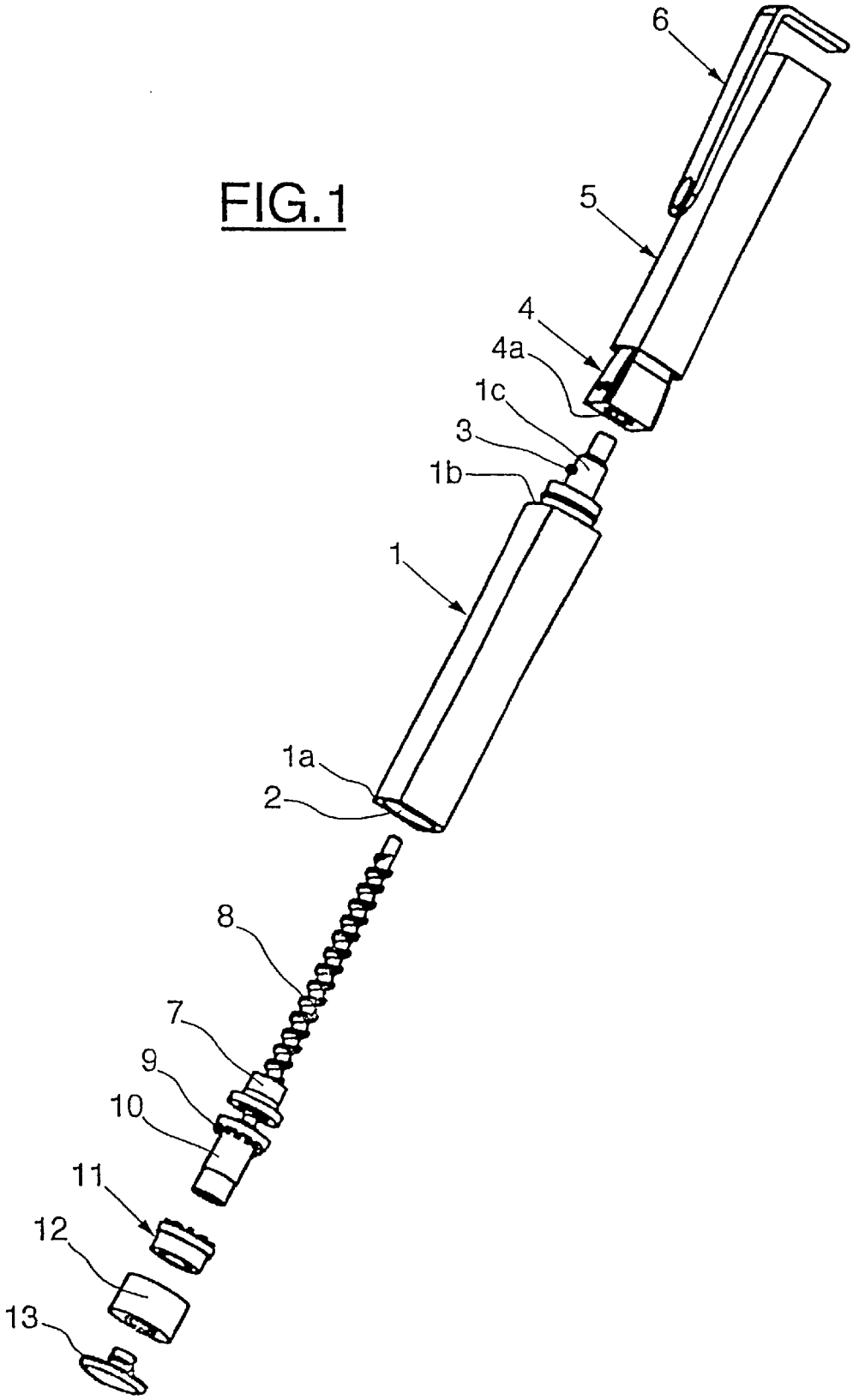
FIG. 1 is an exploded perspective view of a toothbrush according to the invention.
Figure 2:
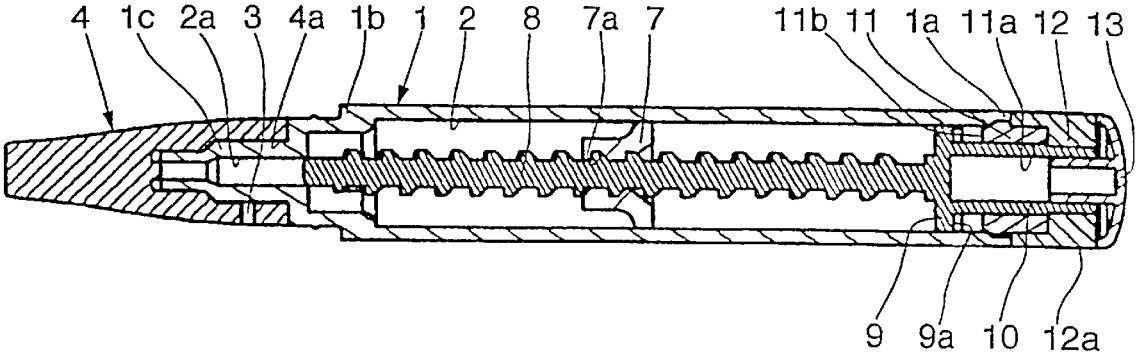
FIG. 2 is a sectional view of the toothbrush shown in FIG. 1.

The toothbrush also has a brush body 4, only part of which can be seen in FIG. 1, the other part being inside the cap 5. The brush body 4 has a hollow portion 4*a* whose shape matches that of the male part 1*c* of the cylinder body 1 and has a locking ramp, not shown, adapted to co-operate with the lug 3 to fasten together the cylinder body 1 and the brush body 4. The end of the brush body 4 inside the cap 5 has rows of bristles for brushing the teeth.

The cap body 5 is designed to surround the brush body 4 and to prevent it from being soiled by dust and other foreign bodies. The cap 5 also has a clip 6 which is fixed to the closed end of the cap 5 and extends along it so that the toothbrush can be carried in a pocket like a pen.

At the end 1*a* of the cylinder body 1 opposite the cap 5 the toothbrush has a non-circular-shape piston 7 which is able to move in translation inside the reservoir 2 of the cylinder body 1 and whose shape matches that of the cross-section of the reservoir 2, so that it is not able to rotate relative to the cylinder body 1. A screwthreaded hole 7*a* passes axially through the piston 7 and receives a screwthreaded rod 8 extending substantially the whole length of the reservoir 2. The screwthreaded rod 8 is extended towards the exterior of the reservoir 2 by a circular disc 9 whose diameter is greater than that of the screwthreaded rod 8 and by a cylindrical portion 10 projecting outwards from the cylinder body 1.

Figure 3:
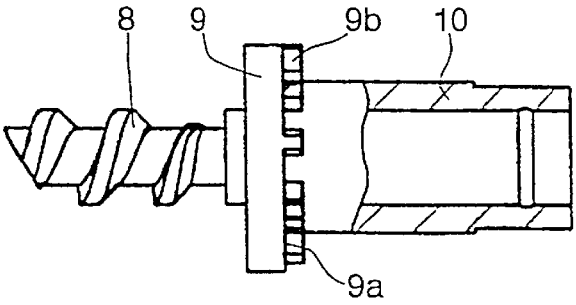
FIG. 3 is a detail view showing the screwthreaded rod and the travel limiter shown in FIG. 2.
Figure 4:
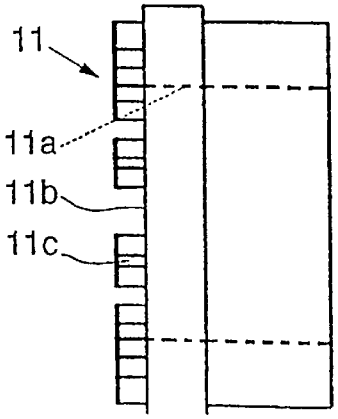
FIG. 4 is an elevation view in profile of the stopper of the toothbrush shown in FIG. 2.

At the open end 1*a* of the cylinder body 1 is a stopper 11 in the form of a sleeve fixed to the cylinder body 1 with a cylindrical hole 11*a* through it, through which the cylindrical portion 10 passes. The cylindrical portion 10 is free to rotate relative to the stopper 11. The stopper 11 has a radial annular surface 11*b* facing a corresponding surface 9*a* of the disc 9. The annular surfaces 9*a* of the disc 9 and 11*b* of the stopper 11 can come into contact with each other and have lugs 9*b* on the surface 9*a* (FIG. 3) and lugs 11*c* on the surface 11*b* (FIG. 4) disposed so that the lugs 9*b* project between the lugs 11*c* and vice versa when the disc 9 moves towards the stopper 11.

Outside the cylindrical body 1 and the stopper 11, the cylindrical portion 10 supports a cylindrical actuator knob 12 partly surrounding the stopper 11 and the cylindrical portion 10. The actuator knob 12 can have an irregular outside surface 12*a* to make it easier to grip. The irregularities can take the form of bosses, pips, axial or other grooves. Finally, a cap 13 is fixed over the free end of the cylindrical portion 10.

The toothpaste is disposed in the reservoir 2 on the opposite side of the stopper 11 to the disc 9 and flows out through an orifice 2*a* of the reservoir 2. The user first removes the stopper 11 from the toothbrush and then separates the brush body 4 from the cylinder body 1. The user then rotates the actuator knob 12, which drives the cylindrical portion 10, the disc 9 and the screwthreaded rod 8. Because of the meshing of the threads on the screwthreaded rod 8 with the screwthreaded hole 7*a* and the piston 7, the screwthreaded rod 8, the disc 9, the cylindrical portion 10 and the actuator knob 12 move not only in rotation but also in translation relative to the cylinder body 1, with a helicoidal motion.

The helicoidal motion stops when the lugs 9*b* on the disc 9 come into contact with the lugs 11*c* on the stopper 11. This contact between the lugs 9*b* and 11*c* stops both the axial component and the circular component of the helicoidal movement.

The user can then see that the actuator knob 12 and the cap 13 have moved away from the cylinder body 1. The user depresses the actuator knob 12 and the cap 13 towards the cylinder body 1. This causes axial movement of these components and of the cylindrical portion 10, the disc 9, the screwthreaded rod 8 and the piston 7 towards the brush body 4, which expels a dose of toothpaste corresponding to the product of the free cross-section of the reservoir 2 by the displacement of the piston 7. Thus it can be seen that exactly the same dose of toothpaste can be expelled from the reservoir 2 on each use and that this dose is proportional to the axial travel of the components mobile in translation relative to the cylinder body 1, in other words the maximum distance between the disc 9 and the stopper 11.

The invention provides a toothbrush which is simple and economical to manufacture since it can be made from a synthetic material and which is perfectly suited to its use, in particular when meals are taken away from home and while travelling. The toothbrush incorporates a reservoir of toothpaste corresponding to a predetermined number of brushings of the teeth, which the user knows, and this reduces the number of times the reservoir of toothpaste has to be changed. The toothbrush is therefore particularly simple to use.

What is claimed is:

1. Toothbrush having:

a hollow handle adapted to be filled with toothpaste, the handle forming a reservoir for the toothpaste and having at a first end an outflow hole for the toothpaste;

a brush part with bristles in the vicinity of the first end of the handle, the handle and the brush part having means for fixing them together end-to-end;

a piston housed in the reservoir and adapted to expel the toothpaste through the outflow hole, the handle having at a second end means for actuating the piston, the piston having a screwthreaded central hole;

a screwthreaded rod cooperating with the screwthreaded central hole of the piston;

a stopper and an actuator knob, one end of the screwthreaded rod passes through the stopper at the second end of the reservoir and is fastened to the actuator knob for actuating the piston, the screwthreaded rod and the actuator knob being mobile in rotation and in translation; and means for limiting the axial travel of the piston, said means being disposed between the piston and the stopper and fastened axially to the rod.

2. The toothbrush according to claims 1, wherein the means for limiting the axial travel of the piston are prevented from rotating relative to the rod.

3. The toothbrush according to claim 1, wherein the screwthreaded rod and the means for limiting the axial travel of the piston are in one piece.

4. The toothbrush according to claim 1, wherein the means for limiting the axial travel of the piston include a disc having a diameter which is greater than that of the screwthreaded rod, and which has an abutment surface adapted to come into contact with a corresponding abutment surface of the stopper.

5. The toothbrush according to claim 4, wherein the abutment surfaces of the disc and the stopper have lugs adapted to prevent the disc rotating relative to the stopper after the disc and the stopper come into contact.

6. The toothbrush according to claim 4, wherein the disc is at a maximum distance proportional to the volume of toothpaste required.

7. The toothbrush according to claim 2, wherein the screwthreaded rod and the means for limiting the axial travel of the piston are in one piece.

8. The toothbrush according to claim 2, wherein the means for limiting the axial travel of the piston include a disc having a diameter which is greater than that of the screwthreaded rod, and which has an abutment surface adapted to come into contact with a corresponding abutment surface of the stopper.

9. The toothbrush according to claim 3, wherein the means for limiting the axial travel of the piston include a disc having a diameter which is greater than that of the screwthreaded rod, and which has an abutment surface adapted to come into contact with a corresponding abutment surface of the stopper.

10. The toothbrush according to claim 7, wherein the means for limiting the axial travel of the piston include a disc having a diameter which is greater than that of the screwthreaded rod, and which has an abutment surface adapted to come into contact with a corresponding abutment surface of the stopper.

11. The toothbrush according to claim 5, wherein the disc is at a maximum distance proportional to the volume of toothpaste required.

* * * * *